United States Patent [19]

Guibert

[11] 4,112,916

[45] Sep. 12, 1978

[54] HOT AIR OVEN FOR FOOD-LOADED CARTRIDGES

[76] Inventor: Raul Guibert, 8343 W. 4th St., Los Angeles, Calif. 90048

[21] Appl. No.: 776,772

[22] Filed: Mar. 11, 1977

Related U.S. Application Data

[63] Continuation-in-part of Ser. No. 713,977, Apr. 12, 1976.

[51] Int. Cl.[2] ..... A47G 23/04

[52] U.S. Cl. ..... 126/261; 99/448; 99/476; 99/447; 206/499; 220/DIG. 13; 219/385; 312/236

[58] Field of Search ..... 126/261, 268; 34/196, 34/195, 197; 219/305, 386, 387, 389, 397; 99/340, 361, 401, 447, 448, 476; 312/236

[56] References Cited

U.S. PATENT DOCUMENTS

| | | | |
|---|---|---|---|
| 1,416,009 | 5/1922 | Forshee | 219/397 |
| 2,541,848 | 2/1951 | Vetter | 312/236 X |
| 2,546,417 | 3/1951 | Anglin | 312/236 |
| 3,074,394 | 1/1963 | Witt | 126/261 |
| 3,261,650 | 7/1966 | Stromquist | 34/196 UX |
| 3,288,129 | 11/1966 | Fox | 126/261 X |
| 3,827,346 | 8/1974 | Tropp | 312/236 X |
| 3,933,145 | 1/1976 | Reich | 126/25 R |

*Primary Examiner*—Harold W. Weakley

*Attorney, Agent, or Firm*—Michael Ebert

[57] ABSTRACT

A hot air oven for heating food-loaded cartridges, each constituted by a stack of sealed trays nested within an open carton whose side walls have holes therein to admit heated air, the trays containing pre-cooked meals. The oven includes a rotating turntable provided with a raised annular shelf for supporting a circular array of cartridges, the side walls of which define a hollow center core. A driven propeller is disposed within the core, the space between the shelf and the turntable forming a restricted flow passage whose inlet communicates with the core and whose outlet lies at the periphery of the turntable. A heater assembly above the cartridge array produces heated air which is sucked by the propeller into the hollow core. Because of the flow restriction, a substantial portion of the heated air is forced through the holes of the cartons to heat the food in the trays. The remaining portion of the heated air passes through the flow passage, the air discharged from the outlet thereof being drawn upwardly by the suction force of the propeller to create an air curtain around the cartridge array. Thus a toroidal loop of heated air fully envelops the heated trays and serves to isolate the trays from the relatively cool ambient air without, however, interfering with direct access to the trays which may be withdrawn from the cartons when the food is at the desired temperature level.

15 Claims, 11 Drawing Figures

Fig. 1.
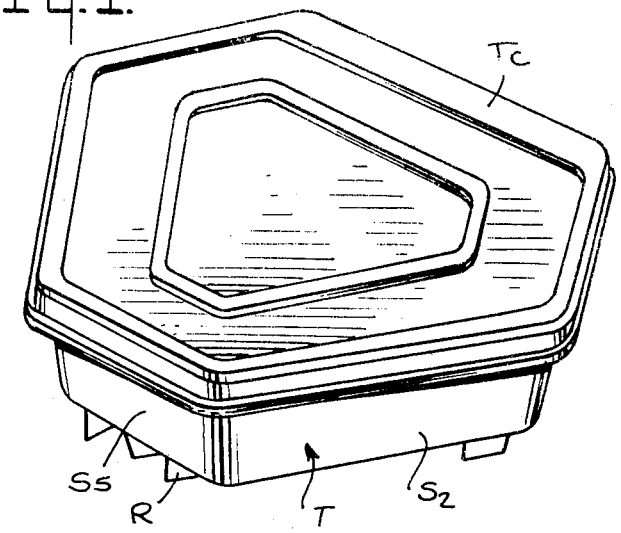
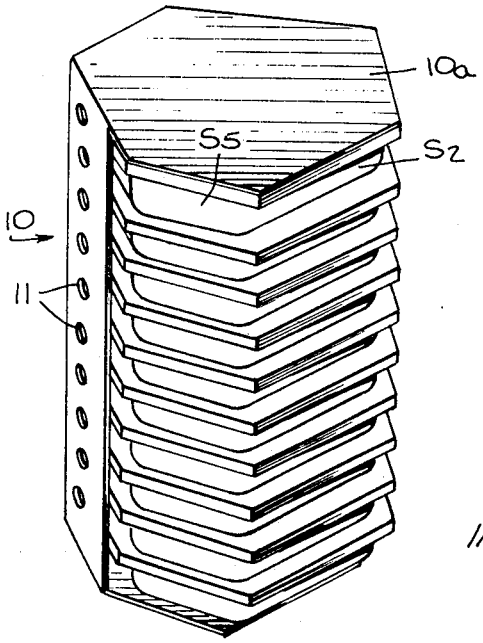
Fig. 4.
Fig. 10.
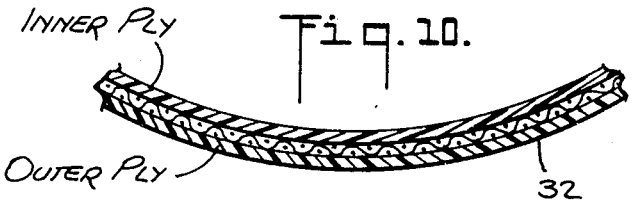
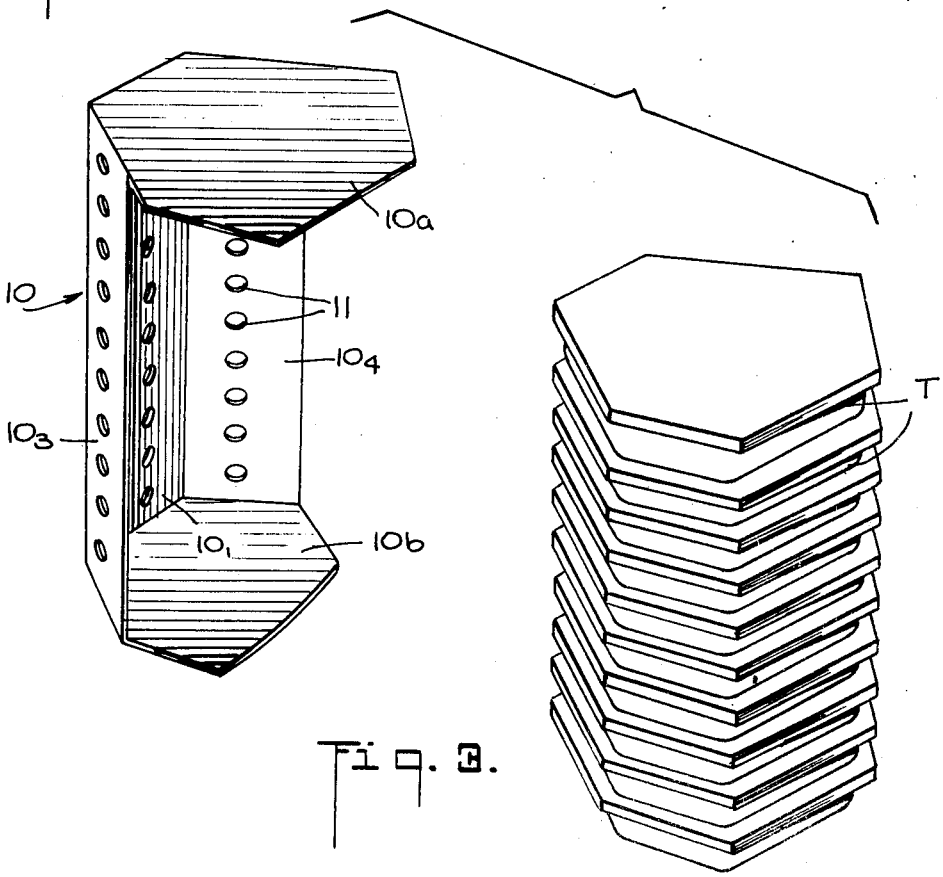
Fig. 3.

27
28
25
13
30
29
C
C
26
24
H
32
14
20B
20A
16
18
17
M
22
20
21
12
15
23

22
32
C
ROTATION
T
S6
S5
11
S2
17
16
18
24
31
AIR FLOW DIRECTION
33

HOT AIR OVEN FOR FOOD-LOADED CARTRIDGES

RELATED APPLICATION

This application is a continuation-in-part of my copending application Ser. No. 713,977, filed Apr. 12, 1976, entitled "Food Processing Technique".

BACKGROUND OF INVENTION

This invention relates generally to a fast food service technique wherein a meal is first cooked, then refrigerated and stored and subsequently reheated without degrading the basic texture, flavor and nutritional qualities of the meal, and more particularly to a hot-air oven reheating the food.

To meet the growing need for quickly-prepared, low-cost meals, fast-food operations have been developed in which the food to be served is deep-freezed and stored, and when an order is placed for a particular item on the menu, the selected item is withdrawn from the freezer and cooked. In some cases, the frozen meal is pre-cooked so that it is only necessary to thaw and reheat the meal.

Though fast food techniques of the type heretofore known make possible relatively inexpensive meals and expedite service, the meals provided thereby are often unappetizing. The reason for this is that while freezing is effective in preserving food and in minimizing contamination, it often does so at the expense of the quality and flavor of the product. In the course of freezing, the moisture content of the food is converted into ice crystals which act destructively; for they rupture the internal structure of the food. As a consequence, frozen food has a characteristically tasteless and mushy quality.

Moreover, in reheating a pre-cooked frozen meal, it is difficult when going from the frozen state to an adequately heated condition to avoid a situation in which the core of the product is still cold even though the outer layer is quite hot. And when one seeks to ensure that the body of the food is hot throughout, there is a tendency to overheat the meal and thereby re-cook it, with a resultant loss of nutritional value and flavor.

A major factor which militates against the success of self-service fast food techniques is that the heated food is necessarily stored in a closed heat chamber which must be opened to obtain access to the product. In a mass feeding operation in which a large number of heated meals must be stored in readiness for withdrawal by customers, this involves a complicated multi-compartment structure, each with a separate door that must be opened to remove the meal and then closed.

In my above-identified co-pending application, there is disclosed a fast food service technique and apparatus therefor whereby pre-cooked food which has been refrigerated may thereafter be reheated and made directly available to customers without degrading the essential texture, flavor or nutritional qualities of the meal.

In the technique disclosed in my copending application, the food to be served to customers is initially in fresh, uncooked condition. For purposes of illustration, we shall assume that the meal to be served is fish and chips and that the starting ingredients are, therefore, cut pieces of fresh fish and potato slices.

We shall further assume that one hundred meals of fish and chips are to be prepared, each meal to be served in an individual tray of sufficient size to accommodate a full meal. To this end, a sufficient amount of freshly cut fish and potato slices are cooked for one hundred meals. After cooking, the cooked products are divided to fill one hundred trays.

It is now necessary to refrigerate the trays to preserve the cooked meals until such time as they are to be served to customers which may be several days later. The trays are kept under refrigeration at a temperature just above their freezing point which, in practice, may be in a range of about 20° to 30° F. Thus where the moisture content of the food is rich in dissolved salts, the freezing point may be well below 32° F. It is important that the refrigeration, while close to freezing, not fall below the freezing point; for the formation of destructive ice crystals in the food must be avoided. It is also important to seal the trays to avoid the loss of moisture and volatile constituents.

Thereafter when the pre-cooked meals are to be dispensed to customers, the trays are taken from the refrigerator and loaded in the open shelves of a heating apparatus which is adapted to raise the temperature of the meals to a point sufficiently hot to inhibit decay (i.e., above 140° F.) but below the point at which the food would proceed to be recooked. Should some of the metals in the heating apparatus not be consumed in the course of a service period, the sealed trays may be returned to the refrigerator and again cooled preparatory to the next demand therefore when they are again heated.

Inasmuch as the refrigeration is at a temperature just above the freezing point, it serves to preserve the food without affecting its quality; and since the subsequent heating of the refrigerated trays maintains the food at a temperature inhibiting spoilage but below the cooking temperature, the heating action is also not injurious. It is possible, therefore, to subject the trays containing pre-cooked meals to more than one cycle of refrigeration and heating without adverse effects.

In the heating apparatus disclosed in my copending application, the refrigerated trays containing pre-cooked food must be individually loaded into open shelves. The shelves surround a central tube having holes therein, the arrangement being such that heated air is blown through the tube. A portion of the heated air passing through the tube is deflected and forced through the holes to heat the trays in the shelves, the remaining portion of the heated air being diverted to form a heated air curtain about the shelves, thereby isolating the heated trays from the relatively cool ambient air without, however, preventing ready access to shelves to remove heated trays therefrom when they are in condition to be served to customers.

While a heating apparatus of the type disclosed in my copending application overcomes the practical drawbacks of heating ovens which require closed doors to maintain food at the desired temperature level and to prevent heat losses, it has certain practical limitations.

The first limitaton is the need to individually load the trays into the heating apparatus, for this is a time-consuming operation. Moreover, since customers must be offered a choice of meals, in order to segregate trays having a meal of one type from trays which a different food content, it is necessary to partition the shelves into separate sectors, each intended for a given type of meal. One must be careful, therefore, when loading the shelves to place the individual trays in the proper sector.

Another limitation resides in the substantial space occupied by the heating apparatus, which, in some instances, rules out its use on a narrow lunchroom counter or other site in which the available space is restricted. Because heated air is forced laterally through spaces between the trays and is deflected thereby, the air emerging from the trays and impinging on the protective curtain is somewhat turbulent and therefore tends to disrupt the curtain. In order to maintain the integrity of the curtain, it must be spaced somewhat from the shelves. This necessarily enlarges the dimensions of the heating apparatus and creates the above-mentioned difficulty.

Yet another limitation of the heating apparatus disclosed in my copending application lies in its inability to quickly raise the temperature of the food in the trays to the proper level. While the heater assembly included in the oven has an adequate capacity to elevate the temperature of the cold food in the trays to the desired level and is thermostatically controllable to maintain this level, the rate at which the temperatue can be raised is relatively slow; hence it takes much more than an hour before the food is ready to be served.

SUMMARY OF INVENTION

In view of the foregoing, the main object of this invention is to provide an improved hot-air oven which obviates the limitations inherent in a heating apparatus of the type disclosed in my copending application.

More particularly, it is an object of this invention to provide an oven adapted to heat food stored in a group of cartridges, each constituted by a stack of sealed meal trays nested within an open carton, making it possible to quickly load the oven. Since each cartridge contains the same meal item, there is no problem is placing trays in proper shelf sectors.

Also an object of this invention is to provide a highly compact hot-air oven having a large food capacity, the air curtain surrounding the heated trays being thermally sheilded to minimize heat transfer.

Still another object of the invention is to provide in an oven of the above-noted type, a two-section heating assembly in which at the outset of heating, both sections are operative for a controllable period sufficient to raise the food temperature to the desired level, after which the main section is rendered inactive while the auxiliary section which draws much less power serves to maintain indefinitely the heated food at the proper level.

Also an object of the invention is to provide an oven in which the cartridges are supported on a rotating turntable which may be momentarily holded to permit the removal of selected trays without the need to cut off the turntable motor or which may be effectively disengaged from the motor for a brief period to permit the cartridges to be loaded thereon.

Briefly stated, these objects are attained in a hot-air oven for heating food-loaded cartridges, each constituted by a stack of sealed trays all containing the same meal, the stack being nested within an open carton whose side walls have holes therein to admit heated air.

The oven includes a rotatable turntable driven through a slip clutch by a motor whereby the turntable may be arrested without cutting off the motor. The clutch is operatively coupled to the turntable by a rotating arm whose pusher finger engages a turntable abutment such that by manually shifting the turntable to a position in advance of the finger, the turntable movement is halted and the turntable may be then loaded with cartridges until such time as the finger again engages the abutment to resume movement.

The turntable is provided with a slightly raised annular shelf for supporting a circular array of cartridges forming a hollow center core whose boundary is defined by the sides of the cartons. Within the core is disposed a driven propeller. The space between the shelf and the turntable forms a restricted flow passage whose inlet communicates with the hollow core and whose outlet lies at the periphery of the turntable.

A heater assembly mounted in the space above the cartridge array produces heated air which is sucked by the propeller into the hollow core. Because of the flow restriction, a substantial portion of the heated air is forced through the holes of the cartons in the cartridge array to heat the food in the trays, the remaining portion passing through the flow passage. The heated air escaping from the outlet of the flow passage is drawn upwardly by the suction force of the propeller to create an air curtain around the cartridge array which returns the air to the heater assembly for reheating and recirculation. The air curtain is surrounded by a thermal shield having a large front port therein to provide access to the interior of the oven whereby cartridges may be inserted therein when loading the shelf and selected trays may be withdrawn therefrom when dispensing meals.

The heater assembly is constituted by two sections of different capacity, both of which are initially energized to raise the oven temperature quickly and to bring the food to the desired temperature level, after which the larger capacity main section is cut off automatically, whereby the food in the oven is thereafter maintained at the desired level by the smaller auxiliary section.

Thus a toroidal loop of heated air is created which fully envelops the heated trays and serves to isolate the trays from the relatively cool ambient air, without, however, interfering with direct access to the trays which may be withdrawn from the cartons through the front port when the meals are at the desired temperature.

OUTLINE OF DRAWINGS

For a better understanding of the invention as well as other objects and further features thereof, reference is made to the following detailed description to be read in conjunction with the accompanying drawings, wherein:

FIG. 1 is a perspective view of a sealed tray;

FIG. 3 illustrates, in perspective, the carton for nesting a stack of trays;

FIG. 4 shows the trays in the carton to form a food-loaded cartridge;

FIG. 10 is a section taken through the terminal shield; and

DESCRIPTION OF INVENTION

The Cartridge

Figure 2:
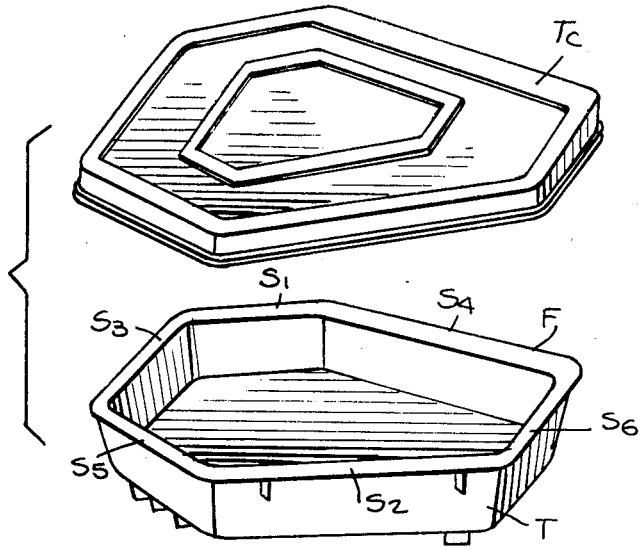
FIG. 2 illustrates the tray with its cover lifted.

Referring now to FIGS. 1 and 2, there is shown a tray T suitable for refrigerating and later serving a precooked meal after the cooled tray has been reheated by hot air in an oven in accordance with the invention. Tray T has a hexagonal configuration constituted by a short rear wall $S_1$, a longer front wall $S_2$, a pair of long side walls $S_3$, $S_4$ adjacent the short rear wall, and a pair of long side walls $S_5$ and $S_6$ adjacent the short front wall. Running along the upper edge of the tray walls is a flange F, onto which is snapped a sealing cover $T_c$ whose geometry matches that of the tray.

The tray and cover are both fabricated of a synthetic plastic material, such as polyethylene, acceptable for and non-reactive with food, the material being capable of withstanding the wide range of temperatures involved in refrigerating and reheating the food contents. Cover $T_c$ is formed of lower density material than tray T so that it is more flexible than the tray and can be pried off without difficulty.

The trays are handled in batches rather than singly. As shown in FIGS. 3 and 4, a stack of ten trays T is nested within a disposable paper carton 10 whose cross-sectional shape conforms to that of the trays. Carton 10 consists of top and bottom walls $\mathbf{10}_a$ and $\mathbf{10}_b$, a rear wall $\mathbf{10}_1$ and a pair of side walls $\mathbf{10}_3$ and $\mathbf{10}_4$ whose dimensions correspond to short rear wall $S_1$ and long side walls $S_3$ and $S_4$ of the trays, so that the stack of trays fits nearly into the carton with the front wall $S_2$ and side walls $S_5$ and $S_6$ exposed to permit easy removal of the trays from the carton. In practice, the front wall of the tray may be labelled to identify the meal stored therein.

Rear wall $\mathbf{10}_1$ and side walls $\mathbf{10}_3$ and $\mathbf{10}_4$ of carton 10 are each provided with a row of large holes 11 to admit heated air into the carton for raising the temperature of the food in the trays nested therein. Circulation of the hot air within the carton is facilitated by the flanges on the trays which maintain spaces between the side walls thereof and the side walls of the carton, and external ribs R on the bases of the trays which maintain spaces between the tray bases and the tray covers. Thus each tray in the stack is exposed to hot air admitted into the carton.

The stack of trays and the carton therefor constitutes a single stock cartridge C. To facilitate handling, the cartridge is preferably enveloped in a clear plastic wrapper which serves to hold the trays in the carton. This wrapper is ripped off before the cartridge is loaded in the hot-air heating oven. In practice, each cartridge is loaded with like trays containing the same item of precooked food, say, a spaghetti or a Chinese dinner.

In order to indicate that the cartridge trays in the oven are in the process of being heating and are not yet ready to be served, a band of paper may be bridged between the top and bottom walls 10*a* and 10*b* of the carton over the exposed front walls $S_2$ of trays T. This band acts as a seal which may be labelled to indicate the cartridge contents. This seal is broken by the operator of the hot-air oven only after he receives notice by means of a pilot light or other means that the food in the trays is at the desired temperature level and in condition to be served.

In the embodiment of the hot-air oven to be later described, the oven capacity is eight cartridges; hence eighty trays of food. Since each cartridge holds a different precooked food preparation, the consumer may be presented with a menu with eight listings. The fact that during a given service period not all of the trays are dispensed does not give rise to waster; for, as explained previously, the unused trays may be returned to a cooling chamber and again refrigerated preparatory to the next demand therefor when they are again heated.

The Hot-Air Oven

Referring now to FIGS. 5 to 11, there is shown an open oven in accordance with the invention which is adapted to accommodate eight cartridges of the type previously described and to raise the temperature of the food contents to a suitable level, say, 170° F., and to then maintain this temperature with a minimal amount of heat loss. Thus the energy requirements for the oven are relatively low, even though the oven has a permanently open access port through which selected food trays may be removed.

The oven includes a circular base 12 which is packed with thermal insulation and a circular roof 13, also packed with thermal insulation. The roof is supported above the base by three equi-spaced metal columns 14 formed by narrow strips of metal whose lower ends curve in under base 12 and then extend downwardly therefrom to form feet 15 which serve to raise base 12 above ground.

Supported below the center of base 12 is a small motor M whose shaft is coupled to a slip clutch 16. The output of clutch 16 is operatively coupled to an arm 17 having a pusher finger 18 at its end, the rotating finger engaging an abutment 19 on the underside of a turntable 20 to drive the turntable. Turntable 20 rides on bearings 21 seated on the upper face of base 12.

Turntable 20 is formed with a central hump 20A and an upturned outer rim 20B. Slightly raised above turntable 20 and supported thereabove by posts is an annular shelf 22 which surrounds hump 20A. The space between shelf 22 and turntable 20 defines a restricted flow passage 23 whose inlet lies at central hump 20A and whose outlet lies at the periphery of the turntable.

Figure 8:
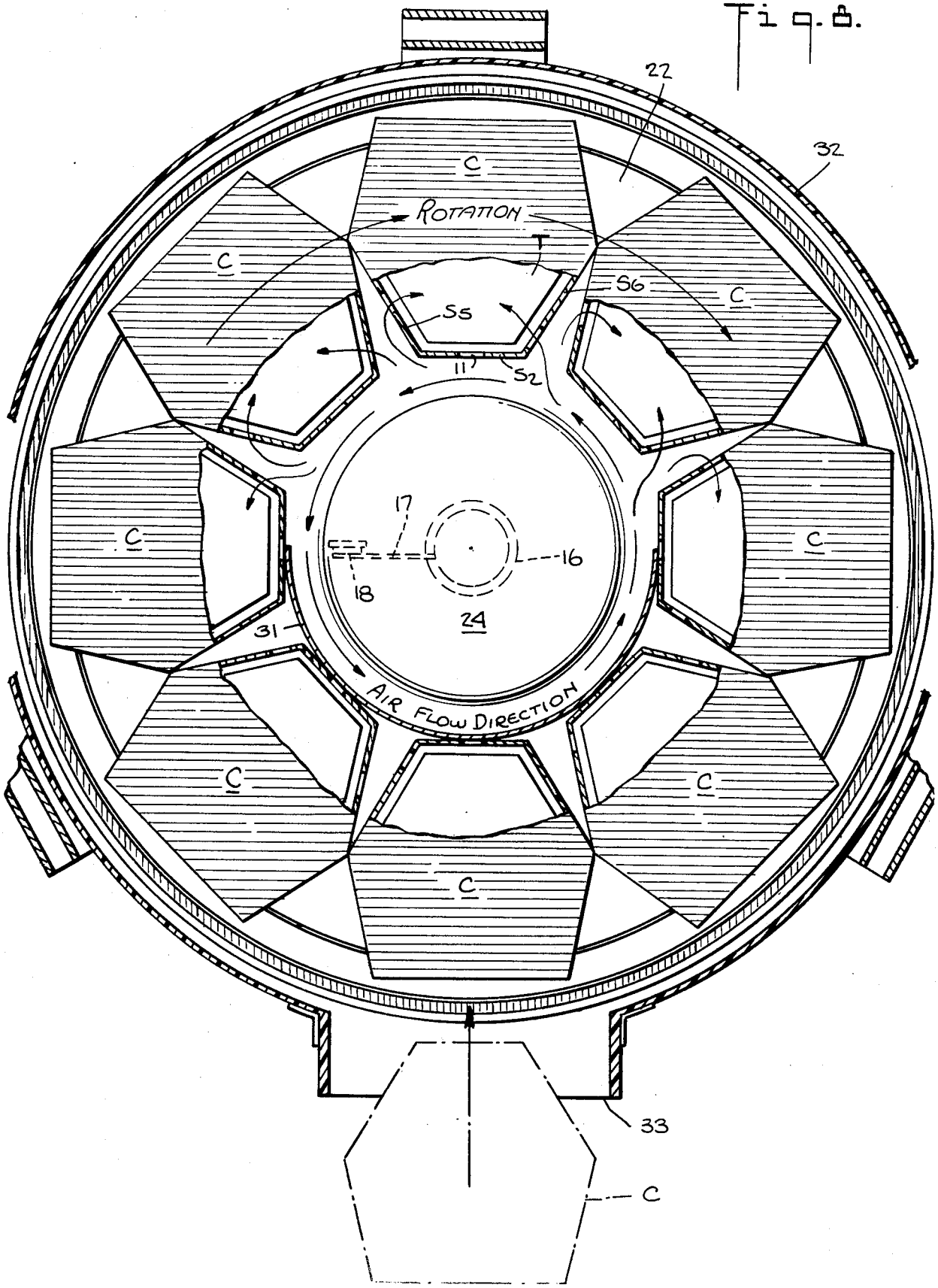
FIG. 8 is a transverse section taken in the plane indicated by line 8—8 in FIG. 5.

Shelf 22 is dimensioned to support a circular array of eight stock cartridges C. The side walls of the cartridge cartons, as best seen in FIG. 8, form the boundary of a hollow central core 24 extending vertically above hump 20A, the hollow core communicating with the inlet to flow passage 23.

Mounted centrally above roof 13 is a motor 25 having an armature shaft which extends downwardly through the roof and terminates in a main propeller 26 disposed within hollow core 24. Attached to the other end of the motor shaft is an auxiliary propeller 27 functioning as a cooling fan for the motor. Propeller 27 blows air into the region between roof 13 and a plastic dome 28 supported thereabove. The space between the dome and the roof serves to house the electrical controls associated with the oven and is ventilated by cooling air from the auxiliary propeller, the head of the dome being vented.

Supported from roof 13 is a heater assembly having a high-wattage main section 29 and an intermediate-wattage auxiliary section 30, the sections being installed in the open space between the upper end of the array of the cartridges C and the overlying roof 13. The sections are formed by heater elements curved to define two concentric circles surrounding the hollow central core 24. Thus the air heated by sections 29 and 30 is sucked into hollow core 24 by the main propeller 26 and is blown therethrough at high velocity to create a flow vortex. Below the heater assembly is an inlet horn H, which is suspended from roof 13 by posts.

Because of the restricted flow passage 23, all of the heated air blown down the core cannot escape therethrough, and a substantial portion thereof is forced through holes 11 in the cartons defining the boundary of the hollow core. It will be seen in FIG. 10 that this boundary is composed of the rear walls $10_1$ of the several cartons which are arranged in a circle, the breaks between these rear walls being bounded by the side walls $10_3$ and $10_4$ which form triangular alcoves. Thus the heated air is forced through the holes 11 not only in rear walls $10_1$ but also in side walls $10_3$ and $10_4$ of the cartons, the heated air penetrating the carton being distributed throughout the spaces between the trays stacked therein, thereby heating the food contents. The pockets created by the alcoves extract heated air from the vortex and serve to dispose the air to supply substantially the same amount of heat to all trays.

Placed vertically within hollow core 24 is an arcuate shield 31, which, as shown in FIG. 8, acts to confine the flow of hot air into the cartridges carried on the turntable to the rear portion of the oven to minimize the escape of air through the access port in the front of the oven.

The portion of the heated air blown down hollow core 24 which is not forced through the array of cartridges to heat the trays passes into the inlet of the restricted flow passage 23 and emerges from the outlet thereof at the periphery of the turntable. Because of suction forces produced by the main propeller, the air escaping from this outlet is drawn upwardly and returned to the space occupied by the heater assembly for recirculation. The upwardly drawn air creates a cylindrical air curtain which surrounds the array of cartridges.

Thus the flow pattern of heated air produced within the oven creates a toroidal loop which fully envelops the circular array of cartridges therein to isolate the heated trays from the cooler ambient air and to minimize heat losses. In order to conserve space, the air curtain is arranged to directly surround the cartridge array and consequently is subject to disruptive impingement by air passing laterally through the trays. The air curtain is therefore surrounded by a cylindrical thermal shield 32. This shield is preferably formed by inner and outer plies of clear synthetic plastic material capable of withstanding the heat of the oven, as shown in FIG. 10. These plies may be of Lexan (a thermoplastic carbonate-linked polymer), between which is sandwiched a woven metal or plastic grid providing an air space separating the plies. Mounted on thermal shield 32 at the front of the oven is a rectangular access port 33 which is large enough to permit the cartridges C to be manually inserted therein and loaded on the turntable shelf.

Because of the slip clutch drive, when making a selection, one may momentarily halt the movement of the turntable by simply holding it manually long enough to remove a selected tray, the clutch then disengaging the turntable from the drive motor. But when loading cartridges on an empty shelf, more time is necessary to allow for this operation; and to this end, one has only to manually shift the turntable to a position well in advance of the push finger on the arm. This serves to disengage the turntable abutment from the rotating drive arm. The turntable then remains undriven until the rotating arm agains engages the abutment. In practice, therefore, assuming a turntable rotation of one turn per 30 seconds, one may shift the turntable to provide a 15-second or so loading interval.

The Control System

Figure 11:
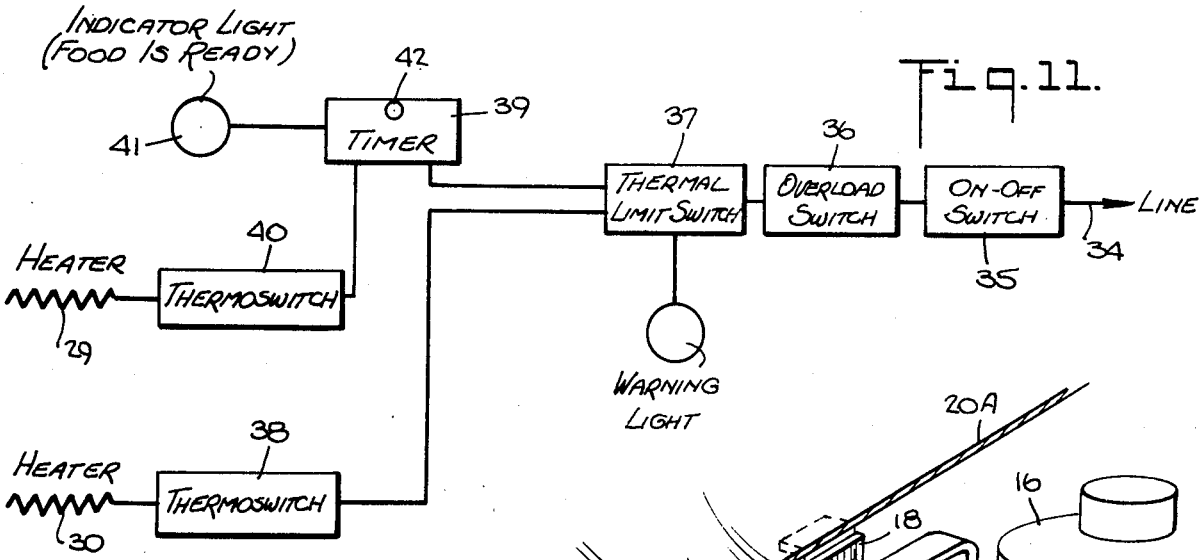
FIG. 11 is a schematic diagram of the electrical circuit of the oven.
Figure 9:
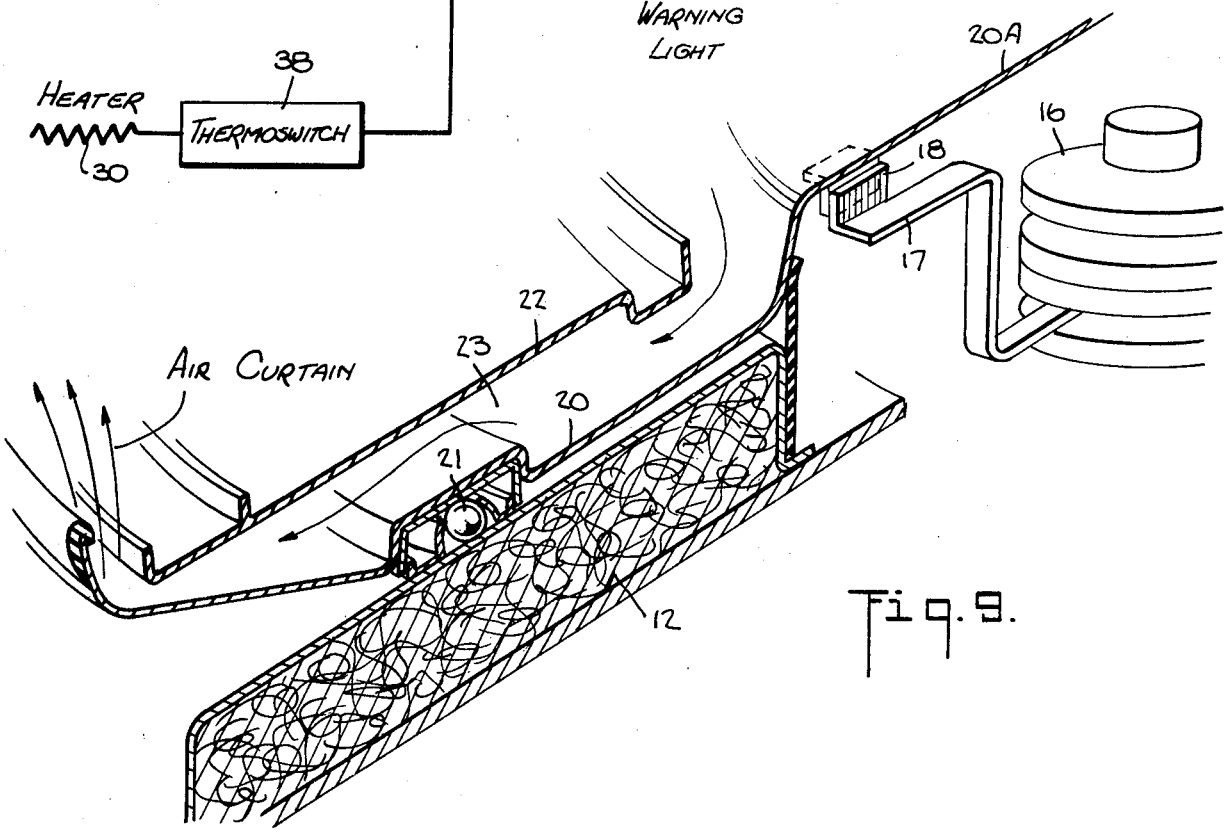
FIG. 9 is a longitudinal section taken through the base portion of the oven.
Figure 5:
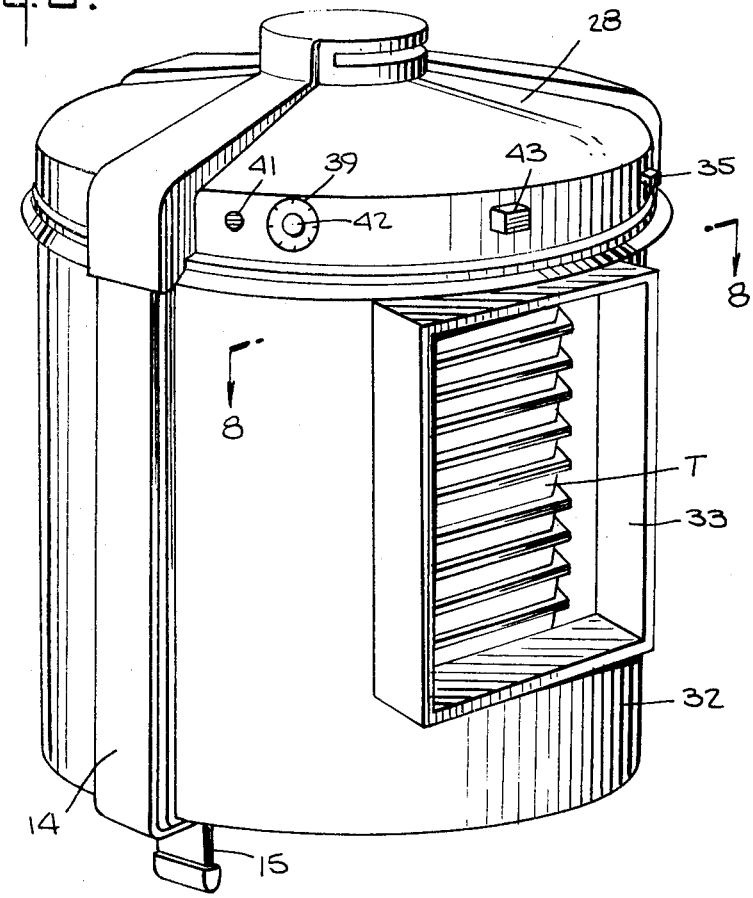
FIG. 5 is a perspective view of a hot-air oven in accordance with the invention for heating food-loaded cartridges of the type shown in FIG. 4.
Figure 6:
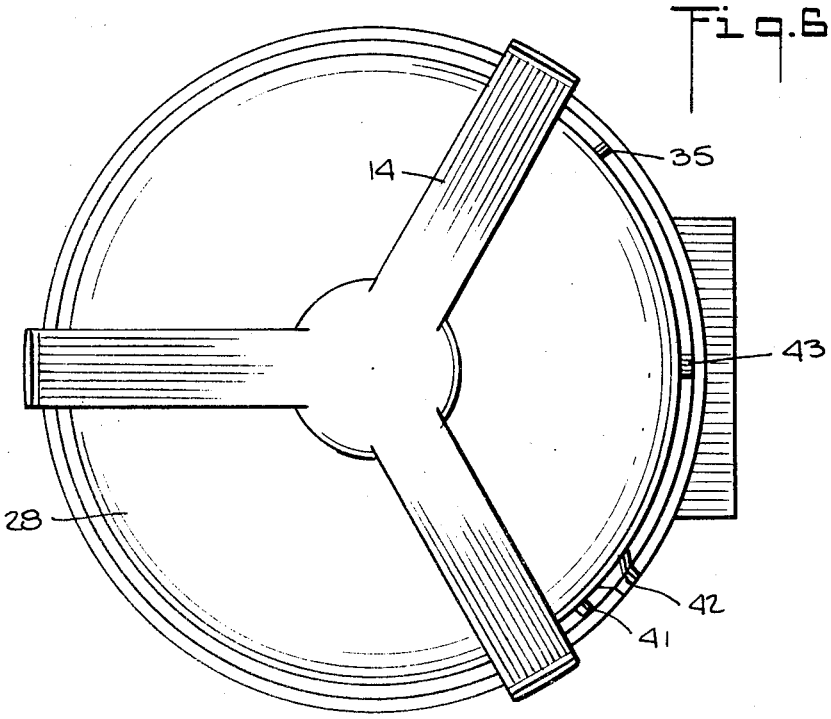
FIG. 6 is a top view of the oven.
Figure 7:
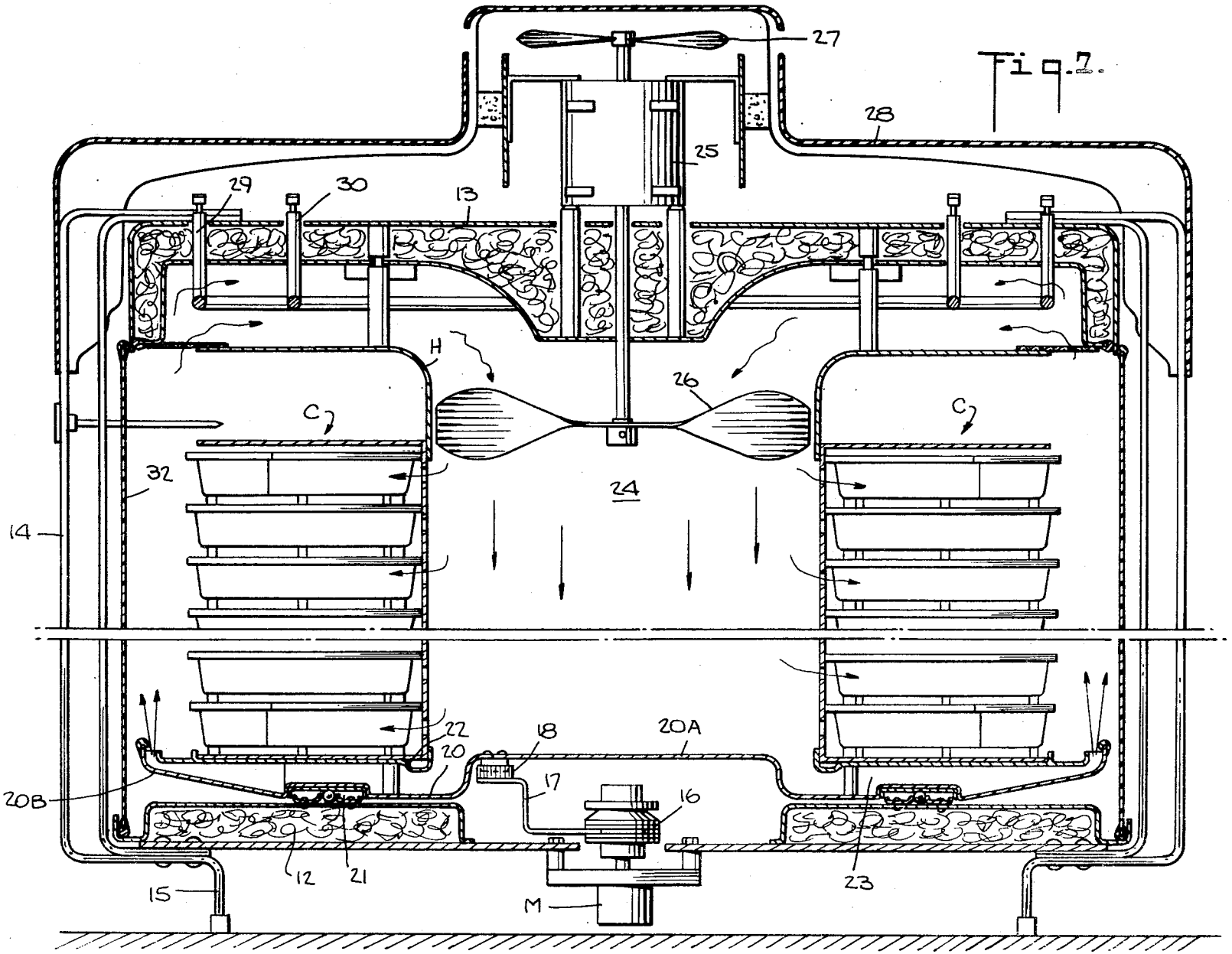
FIG. 7 is a longitudinal section taken through the oven.

As shown in FIG. 11, the main heater element 29 and the auxiliary heater element 30 are both energized through a power line 34 having an on-off switch 35 therein which serves to turn on power for both elements. The line from switch 35 goes through a protective overload switch 36 into a thermostat switch 37 which cuts off power to both heater elements should the heat in the oven exceed a pre-set value.

From limit switch 37 there are two line branches: one leading to auxiliary heater 30 through a thermostat switch 38, and the other leading to main heater 29 through a controllable timer 39 and a thermostat switch 40. Associated with timer 39 is an indicator light 41 which is normally off and turns on only when the timer runs out. Timer 39 is provided with an operating button 42. The fact that the line power is switched on is indicated by a pilot light 43. Timer 39, main switch 35, pilot light 43 and indicator light 41 are all mounted on the dome of the oven.

When power is turned on, auxiliary heater 30 is immediately energized, whereas main heater 29 is energized only after timer button 42 is pressed in. This timer is adjustable; and assuming that it takes 1 hour using both heater elements to bring the food in the oven to the proper temperature level, say, 150° F., then the timer is set for 1 hour.

At the end of the one-hour timing interval, timer 39 cuts off power to the main heater, at which point the indicator light 41 turns on to give notice that the meals are ready to be served. Thereafter, auxiliary heater 30, which remains operative under the control of thermostat 38, which is set to 150° F., functions to maintain the desired temperature level.

While there has been shown and described a preferred embodiment of a hot air oven for food-loaded cartridges in accordance with the invention, it will be appreciated that many changes and modifications may be made therein without, however, departing from the essential spirit thereof. for example, the invention is not limited to cartridges in which the cartons are loaded with trays, for the food to be heated may be contained in sacks or other containers receivable within the cartons. It is to be noted that while at the outset of the heating operation, all cartridges are fully loaded with trays, the removal of the trays does not degrade the operation of the oven; for even with most trays removed, the cartons which stay in place bring about a proper dispersion of the heated air with regard to the remaining trays or containers.

I claim:

1. A hot-air oven for heating food comprising:

A. a turntable having a slightly raised annular shelf for supporting a load of food in a toroidal configuration, the space between said shelf and said turntable defining a restricted flow passage whose inlet is at the inner periphery of said shelf and whose outlet is at the outer periphery thereof, said load having a hollow central core whose boundary is defined by the inner surface of the load, said core communicating with the inlet of the restricted flow passage;

B. a heater assembly disposed in the region above the upper end of said load to heat the air in this region; and C. flow directing means including a driven propeller disposed in said core to draw heated air from said region and to propel said heated air downwardly in a flow path passing through said central core into the inlet of said restricted flow passage, and from the outlet of said passage upwardly to create an air curtain surrounding the outer surface of said load, the heated air from the air curtain being returned to said region for recycling through said flow path, thereby enveloping said load in a recirculating toroidal flow pattern.

2. An oven as set forth in claim 1, wherein said load having a toroidal configuration is created by an array of cartridges each formed by a carton whose rear wall has holes therein and food containers nested in said carton, the rear walls of said cartons defining the boundary of said core.

3. An oven as set forth in claim 2, wherein said food containers are constituted by a stack of sealed trays each containing a pre-cooked meal.

4. An oven as set forth in claim 3, wherein said trays have a hexagonal form and said cartons, in addition to said rear wall, have two side walls, which carton walls correspond to three sides of said trays, the other three sides being exposed to permit ready removal of said trays.

5. An oven as set forth in claim 1, further including a thermally-insulated base supporting said turntable and a thermally-insulated roof mounted above the load carried on the turntable shelf, said heater assembly being suspended from said roof.

6. An oven as set forth in claim 5, further including a cylindrical thermal shield extending between said base and said roof and surrounding said air curtain, said shield having an open-port providing access to said turntable for loading same or withdrawing food therefrom.

7. An oven as set forth in claim 6, wherein said shield is constituted by two piles of clear plastic material separated by a grid to provide an air space between the plies.

8. An oven as set forth in claim 7, wherein said grid is formed by woven wire mesh material.

9. An oven as set forth in claim 1, wherein said heater assembly is formed by a main high-wattage section and an auxiliary section of lower wattage.

10. An oven as set forth in claim 9, wherein said sections are curved to form two concentric circles about said core.

11. An oven as set forth in claim 9, further including timer means to activate said main section for a predetermined period to bring about a rapid rise in food temperature until a desired level is reached, which level is thereafter maintained by the auxiliary section.

12. An oven as set forth in claim 1, further including a motor for driving the turntable and a slip clutch interposed between the motor and the turntable to permit manual stoppage of the turntable without turning off the motor.

13. An oven as set forth in claim 12, wherein said slip clutch is provided with an arm having a pusher finger engaging an abutment on said turntable whereby by manually shifting the turntable to advance it with respect to the finger, movement thereof is halted until the finger catches up with the abutment.

14. An oven as set forth in claim 5, wherein said propeller is driven by a drive motor mounted above said roof.

15. An oven as set forth in claim 14, wherein said drive motor is provided with an auxiliary propeller for cooling said motor.

* * * * *

UNITED STATES PATENT OFFICE

CERTIFICATE OF CORRECTION

Patent No. 4,112,916 Dated September 12, 1978

Inventor(s) Raul Guibert

It is certified that error appears in the above-identified patent and that said Letters Patent are hereby corrected as shown below:

Col. 2, line 24 "metals" should have read -- meals --

Col. 2, line 61 "which" should have read -- with --

Col. 3, line 38 "sheilded" should have read -- shielded --

Col. 4, line 65 "terminal" should have read -- thermal --

Col. 5, line 55 "heating" should have read -- heated --

Col. 6, line 3 "waster" should have read -- waste --

Signed and Sealed this

*Twelfth* Day of *December 1978*

[SEAL]

*Attest:*

RUTH C. MASON
*Attesting Officer*

DONALD W. BANNER
*Commissioner of Patents and Trademarks*